US007422475B2

(12) United States Patent
Hirata

(10) Patent No.: US 7,422,475 B2
(45) Date of Patent: Sep. 9, 2008

(54) ELECTRICAL CONNECTOR

(75) Inventor: Yoshikazu Hirata, Tokyo (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/336,575

(22) Filed: Jan. 20, 2006

(65) Prior Publication Data

US 2006/0166556 A1 Jul. 27, 2006

(30) Foreign Application Priority Data

Jan. 21, 2005 (JP) ..... 2005-014763

(51) Int. Cl.
*H01R 13/60* (2006.01)

(52) U.S. Cl. ..... 439/541.5

(58) Field of Classification Search ..... 439/541.5, 439/607–610, 660, 79

See application file for complete search history.

(56) References Cited

U.S. PATENT DOCUMENTS 5,169,324 A 12/1992 Lemke et al.
5,474,472 A 12/1995 Niwa et al.
5,564,949 A 10/1996 Wellinsky
6,120,321 A * 9/2000 Wu ..... 439/541.5
6,350,152 B1 * 2/2002 Belopolsky et al. ..... 439/541.5
6,835,091 B2 * 12/2004 Oleynick et al. ..... 439/541.5
6,939,168 B2 * 9/2005 Oleynick et al. ..... 439/541.5

FOREIGN PATENT DOCUMENTS

JP 09-259965 10/1997

* cited by examiner

*Primary Examiner*—Gary F. Paumen
(74) *Attorney, Agent, or Firm*—Barley Snyder LLC

(57) ABSTRACT

An electrical connector which can prevent damage to a protective wall is disclosed. The protective wall protects contact sections of the contacts and protrudes into the interior of the cavity in the housing to avoid damage to the contact sections, during the twist-insertion of the mating connector. The electrical connector A comprises a housing 10 that is formed of an insulating material and contacts 20 that are attached to the housing 10. The housing 10 has a cavity 31 that receives the mating connector B. The protective wall 12 that protects the contact sections 22 of the contacts 20 is integrally provided with the housing 10 so that this protective wall 12 protrudes from the bottom portion of the cavity 31 into the interior of the cavity 31. A metal plate 40 that covers at least portions of the surfaces of the protective wall 12 is provided.

14 Claims, 7 Drawing Sheets

PRIOR ART

ELECTRICAL CONNECTOR

FIELD OF THE INVENTION

The present invention relates to an electrical connector which can prevent damage to a protective wall made of plastic that protects the contact sections of the contacts and that protrudes into the interior of the cavity of the housing, and which can securely avoid damage to the contact sections, during the twist-insertion (i.e., KOJIRI-insertion) of a mating connector.

BACKGROUND

The electrical connector shown in FIG. 8 (see JP9-259965A), for example, is a known electrical connector that protects the contact sections of the contacts during the twist-insertion of a mating connector.

This electrical connector 101 shown in FIG. 8 comprises an insulating housing 110 and contacts 120 that are attached to the housing 110 in a plurality of rows.

The housing 110 is formed by molding an insulating material, and has a cavity 111 that accommodates a mating connector (not shown in the figure). a plurality of protective walls 112 that extend from the bottom portion of the cavity 111 and that are integrally provided with the housing 110 protrude into the interior of this cavity 111. Furthermore, a plurality of rows of guide walls 113 that extend from the bottom portion of the cavity 111 and that are integrally provided with the housing 110 protrude into the interior of this cavity 111.

Meanwhile, each contact 120 is formed by stamping and forming a metal plate, and comprises a supported section 121 that is supported by the housing 110, a flexible contact section 122 that extends from one end of the supported section 121 and that is formed by bending, and a terminal leg 123 that extends from the other end of the supported section 121 and that is connected to a circuit board (not shown in the figure). The contact sections 122 are designed to be contacted by the contacts (not shown in the figure) that are provided on the mating connector. Furthermore, portions of each contact section 122 and the supported section 121 in a range corresponding to the contact section 122-are accommodated in an contact receiving area 112*a* that is formed on the corresponding protective wall 112 of the housing 110. As a result, it is possible to protect the contact sections 122 of the contacts 120, which are the most susceptible to damage by twist-insertion of the mating connector.

However, problems have been encountered in this conventional electrical connector 101. Specifically, when the mating connector is twisted inside the cavity 111 of the housing 110 during the mating of the mating connector, there are cases in which the protective walls 112 made of plastic are damaged as a result of the mating connector contacting the tip ends of these protective walls 112, resulting in damage to the contact sections 122 of the contacts 120.

SUMMARY

Accordingly, the present invention was devised in light of the problems described above and it is an object of the present invention to provide an electrical connector which can prevent damage to a protective wall, and which can securely avoid damage to the contact sections during the twist insertion of the mating connector.

In order to address the problems described above, an electrical connector according to the invention comprises a housing that is formed by molding an insulating material and contacts that are attached to this housing. The housing has a cavity that receives a mating connector. a protective wall in the cavity protects the contact sections of the contacts and is integrally formed with the housing such that this protective wall protrudes from the bottom portion of the cavity into the interior of the cavity. a metal plate that covers at least portions of the surfaces of the protective wall is also provided. It should be understood that the housing itself may have a cavity, or that a separate member may be provided to form the cavity.

DETAILED DESCRIPTION OF THE EMBODIMENT(S)

Figure 1:
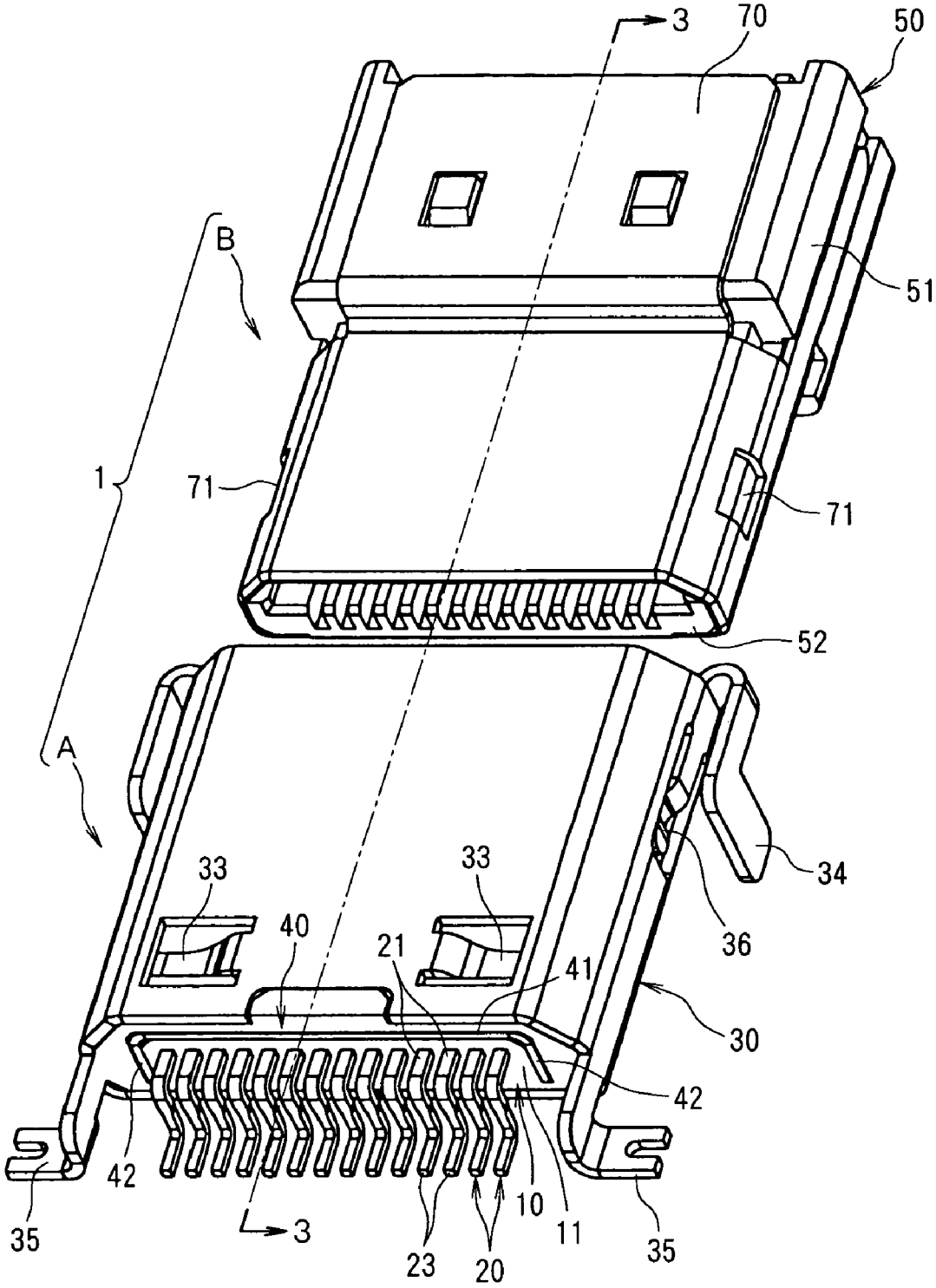
FIG. 1 is a perspective view of an electrical connector assembly consisting of the electrical connector of the invention and a mating connector that mates with this electrical connector.
Figure 2:
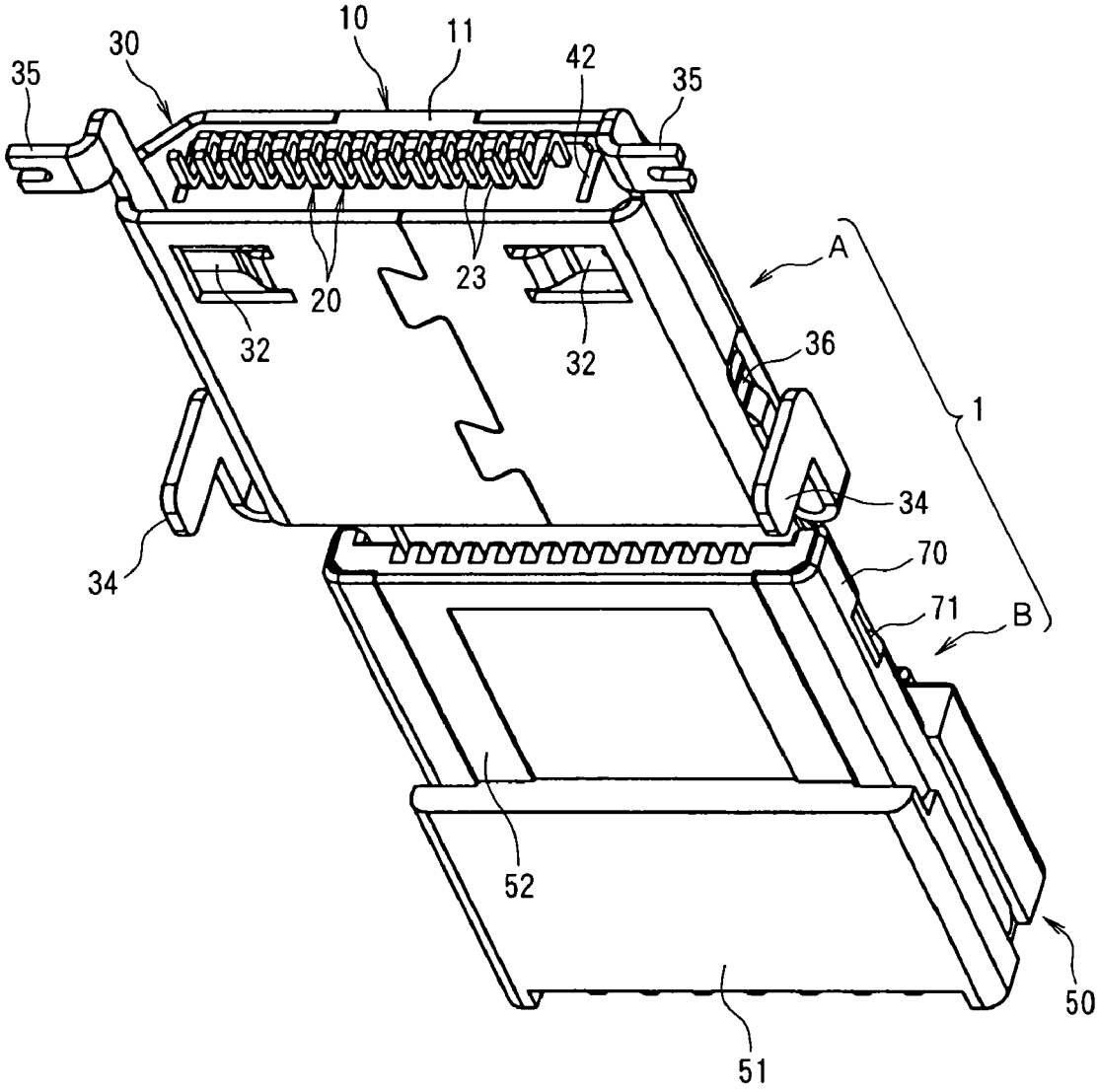
FIG. 2 is a perspective view of the electrical connector assembly of FIG. 1 as seen from the rear bottom side.

Next, an embodiment of the present invention will be described with reference to the figures. In FIGS. 1 and 2, the electrical connector assembly 1 comprises an electrical connector a that is mounted on a circuit board (not shown in the figures) and a mating connector B that mates with this electrical connector A.

Here, as is shown in FIGS. 1 to 3, 4A and 4B, and 5A to 5C, the electrical connector A comprises a housing 10, a plurality of contacts 20 that are attached to the housing 10, and a metal shell 30 that is attached to the housing 10.

Figure 3:
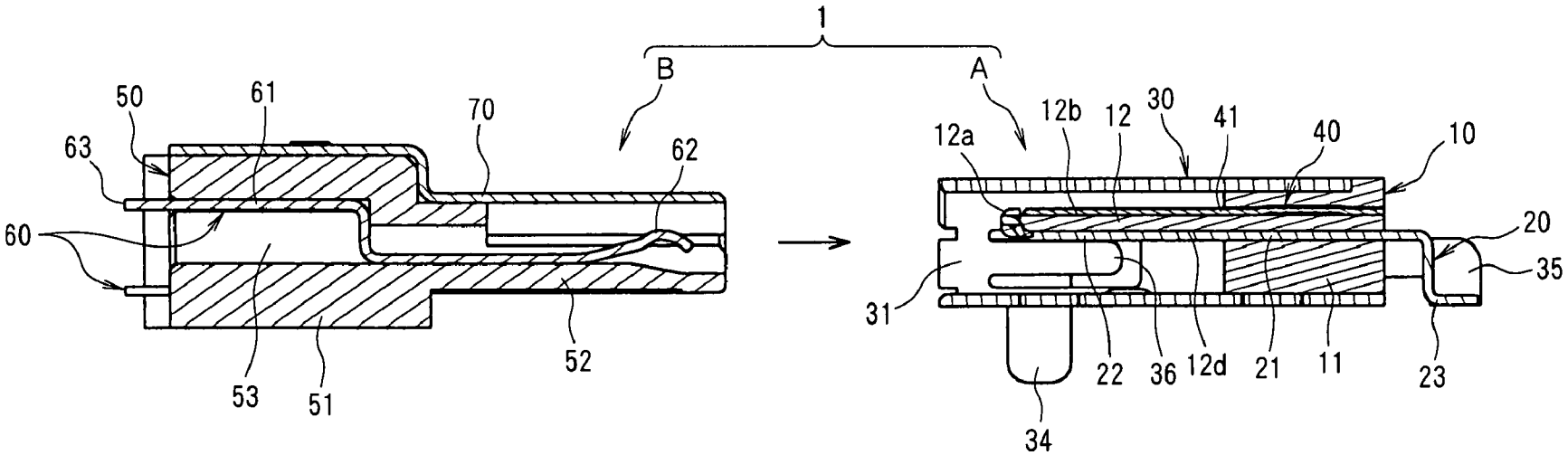
FIG. 3 is a sectional view along line 3-3 in FIG. 1.
Figure 4A:
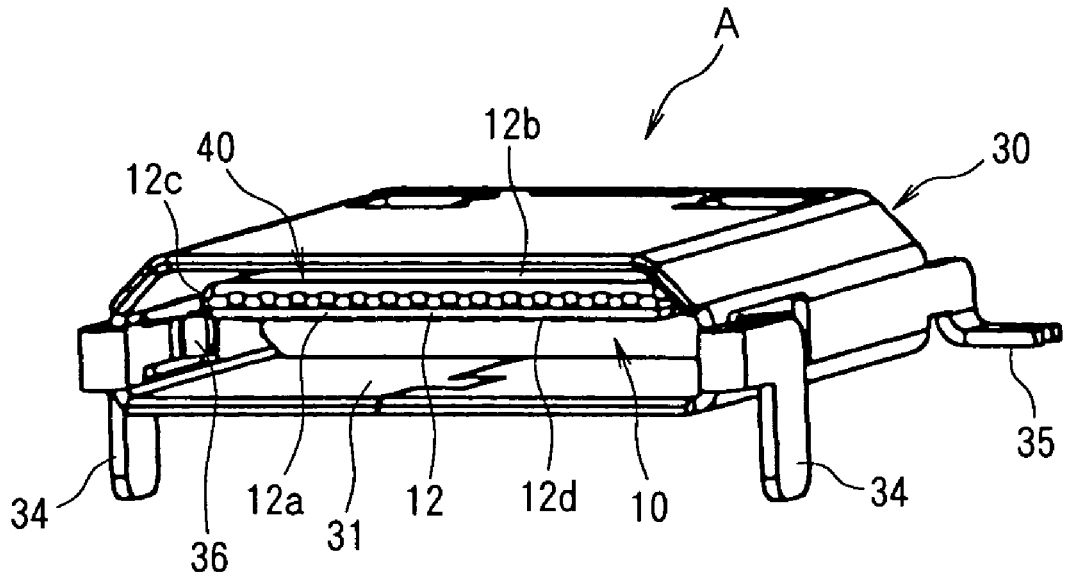
FIGS. 4A and 4B show the electrical connector of the present invention, with FIG. 4A being a perspective view as seen from the front top, and FIG. 4B being a perspective view as seen from the front bottom.
Figure 4B:
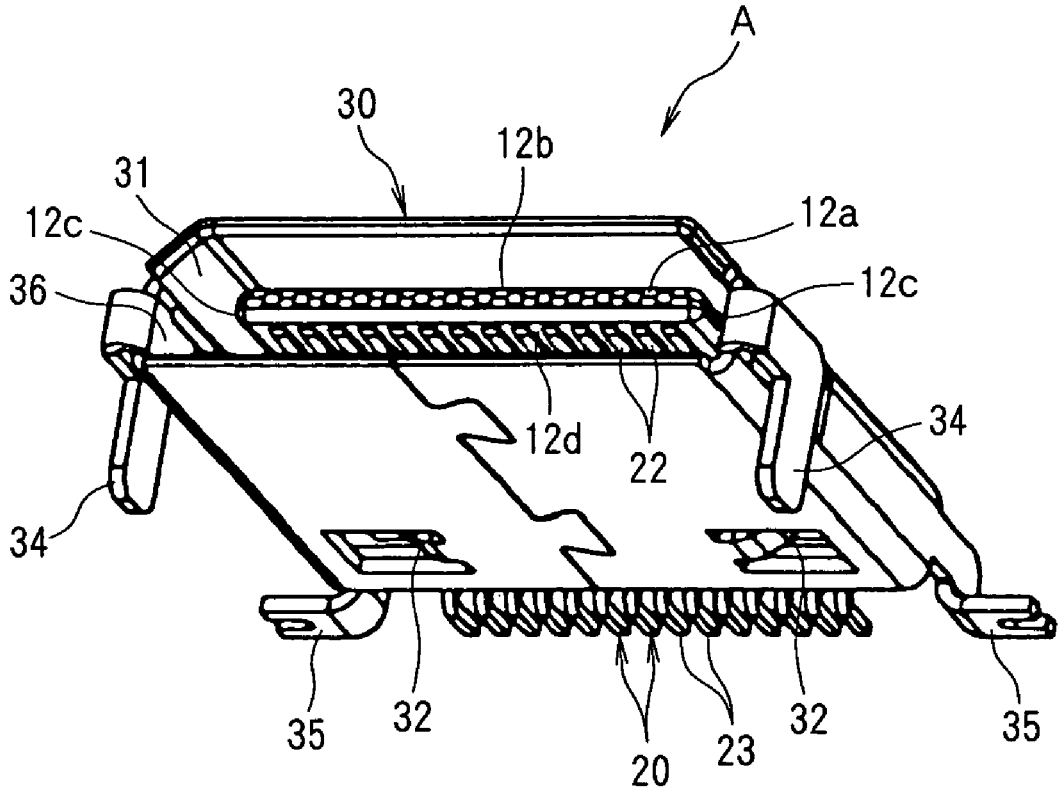
Figure 5A:
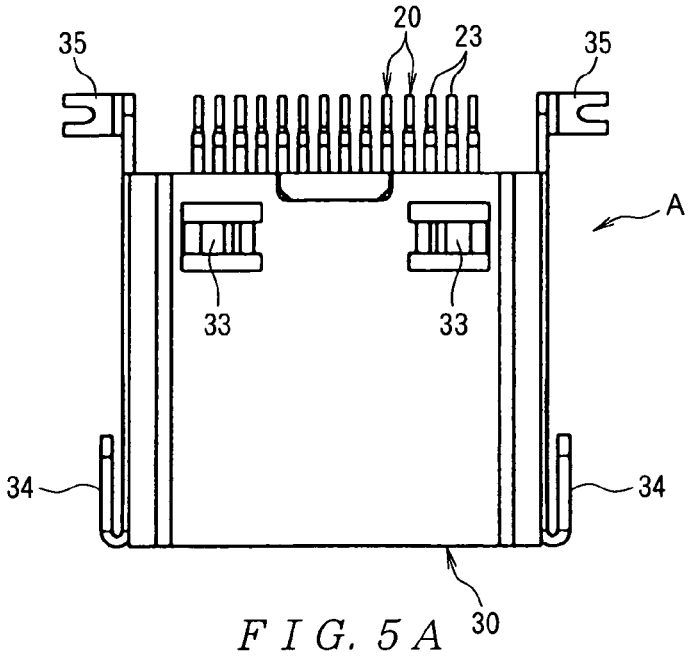
FIGS. 5A to 5C show the electrical connector of the present invention, with FIG. 5A being a plan view, FIG. 5B being a front view, and FIG. 5C being a bottom view.
Figure 5B:
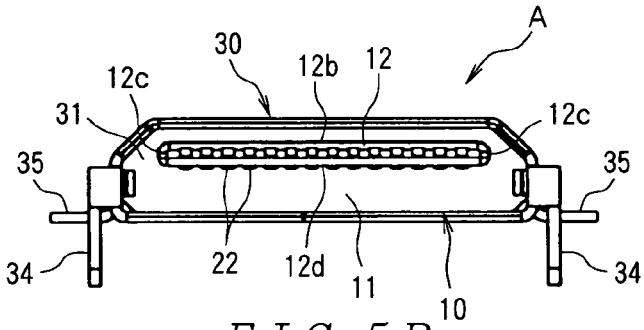
Figure 5C:
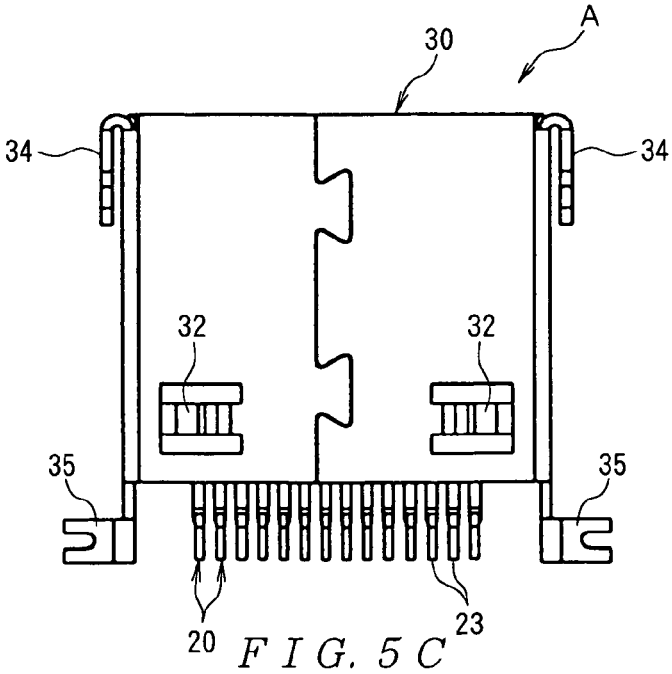
Figure 6A:
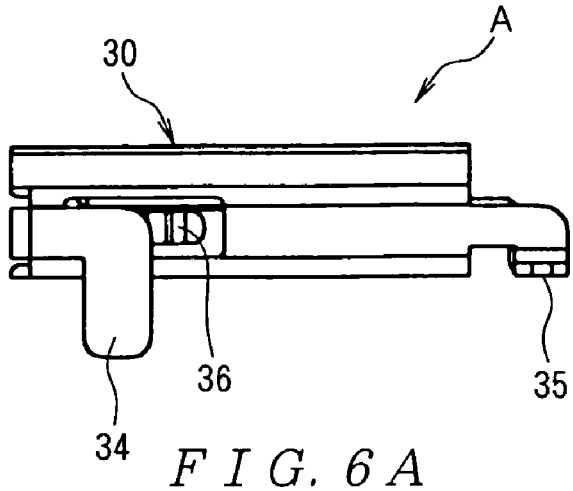
FIGS. 6A to 6C show the electrical connector of the present invention, with FIG. 6A being a right-side view, FIG. 6B being a left-side view, and FIG. 6C being a back view.
Figure 6B:
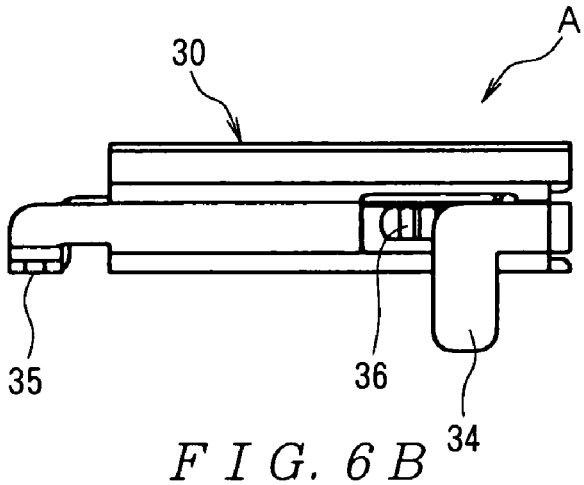
Figure 6C:
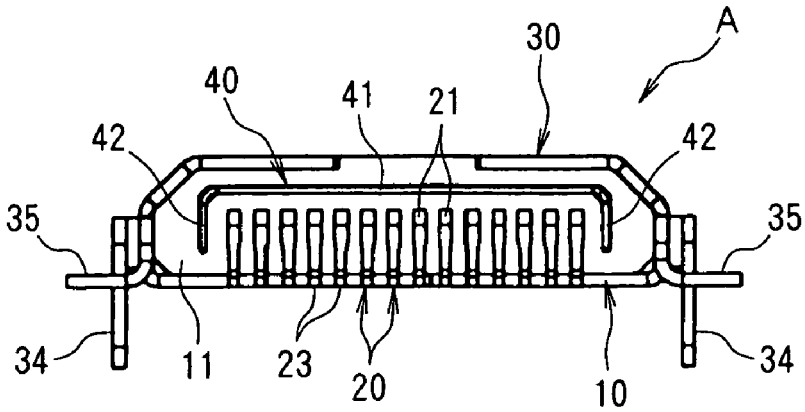
Figure 7:
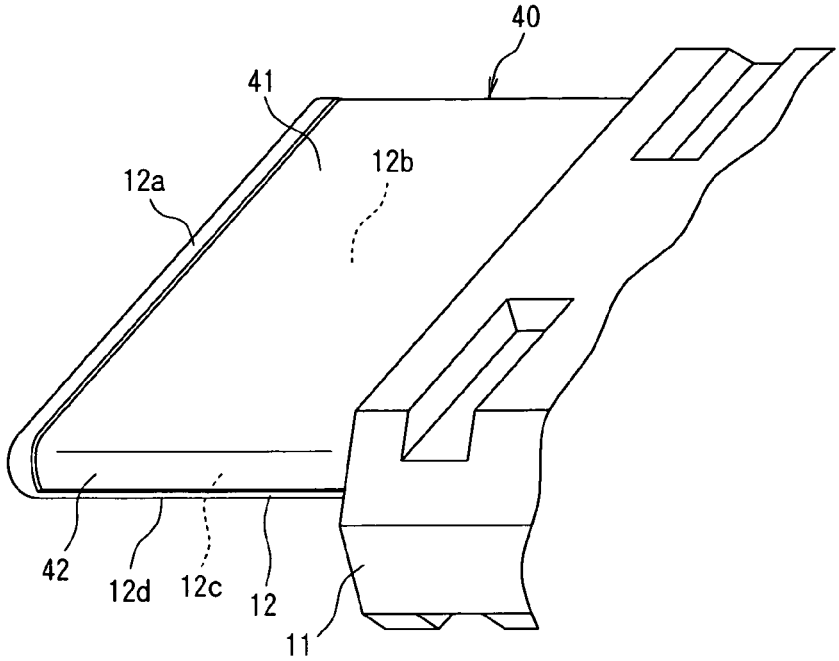
FIG. 7 is a perspective view of the protective wall portion of the electrical connector of the present invention.
Figure 8:
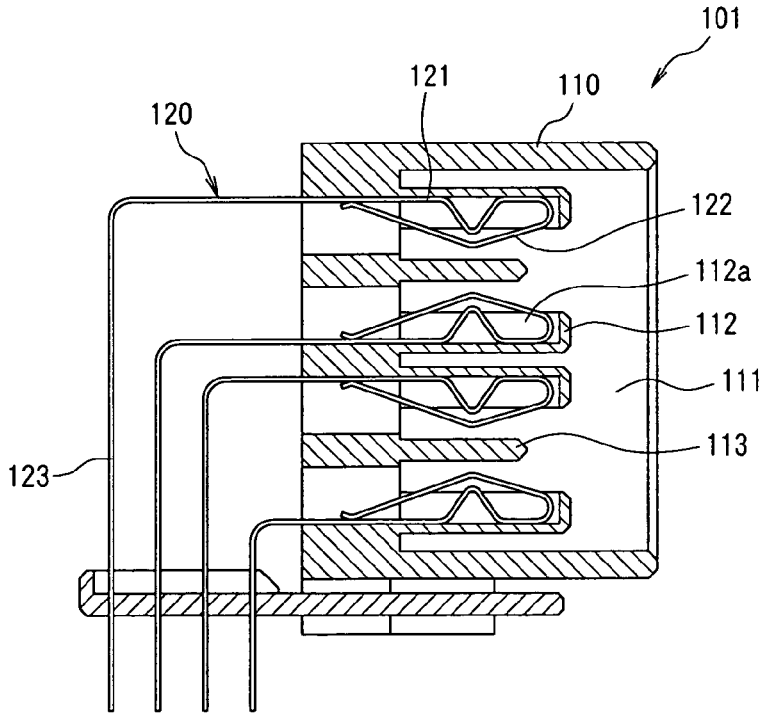
FIG. 8 is a sectional view of a conventional example of an electrical connector.

The housing 10 is formed by molding an insulating material, and comprises a rectangular main body 11 that extends in the direction of width (left-right direction in FIG. 5A) and a protective wall 12 that extends forward (downward in FIG. 5A) from the front end surface of this main body 11. As is shown in FIGS. 5B and 7, the protective wall 12 has a substantially rectangular shape that extends in the direction of width of the main body 11 with a slightly smaller width than the width of the main body 11. The protective wall 12 has the upper surface 12*b*, two side surfaces 12*c*, and undersurface 12*d* and is formed integrally with the main body 11. The position of the protective wall 12 in the vertical direction is slightly above the center of the main body 11 in the vertical direction. As is shown in FIG. 3, a protective part 12*a* that protects the front ends of the contact sections 22 of the contacts 20 by protruding slightly more downward than the undersurface of the protective wall 12 is provided on the front end of the protective wall 12.

Furthermore, the contacts 20 are attached in a single row along the direction of width of the housing 10. Each contact 20 comprises a secured part 21 that extends in the forward-rearward direction and that is press-fitted to the main body 11 of the housing 10, a contact section 22 that extends forward from the front end of the secured part 21 and that is supported along the undersurface 12*d* of the protective wall 12, and a connecting part 23 that extends rearward from the rear end of the secured part 21 and that is connected by soldering to the surface of the circuit board. Each contact 20 is formed by stamping and forming a metal plate. The contact sections 22 are designed so that the elastic contact sections 62 of the mating contacts 60 provided on the mating connector B elastically contact the respective undersurfaces of these contact sections 22. The position of the front end of each contact section 22 is located slightly toward the rear of the protective part 12*a* that is provided on the front end of the protective wall 12, so that the front ends of the contact sections 22 are protected by the protective part 12*a*.

Moreover, a shell 30 made of metal is attached to the main body 11 of the housing 10. The shell 30 is formed by stamping and forming a metal plate, and is attached to the main body 11 so as to cover the main body 11 and protective wall 12. The shell 30 is attached to the main-body 11 by first locking members 32 that are provided on the rear portion of the lower plate part of the shell 30 and second locking members 33 that are provided on the top rear portion of the shell 30. The front end of the shell 30 protrudes farther forward than the protective part 12*a* provided on the front end of the protective wall 12. The portion surrounded by the shell 30 on the front side of the main body 11 forms a cavity 31 that receives the mating part of the mating connector B. Accordingly, the protective wall 12 that protects the contact sections 22 of the contacts 20 protrudes into the interior of the cavity 31 from the bottom portion of the cavity 31 (i.e.,from the front end surface of the main body 11). Furthermore, first fastening parts 34 for fastening the shell 30 to the circuit board are provided on the front ends of the two side plate parts of the shell 30, and second fastening parts 35 for fastening the shell 30 to the circuit board are provided on the rear ends of the two side plate parts of the shell 30. Moreover, locking projections 36 that are elastically locked with locking recesses 71 of the mating connector B are provided toward the front of the two side plate parts of the shell 30.

Furthermore, a metal plate 40 that is formed so as to cover the upper surface 12*b* and two side surfaces 12*c* of the protective wall 12 is fastened to the main body 11 of the housing 10. The metal plate 40 comprises an upper plate part 41 that is fastened to the main body 11 and that covers the upper surface 12*b* of the protective wall 12, and side plate parts 42 that are formed by bending both sides of the upper plate part 41 and that respectively cover the two side surfaces 12*c* of the protective wall 12. The metal plate 40 is not designed to cover the protective part 12*a* that is provided on the front end of the protective wall 12.

Meanwhile, the mating connector B that mates with the electrical connector A comprises an insulating mating housing 50 and a plurality of mating contacts 60 that are attached to the housing 50.

Here, the mating housing 50 is formed by molding an insulating material, and comprises a rectangular main body 51 that extends in the direction of width (direction perpendicular to the plane of the page in FIG. 3), and a mating protruding part 52 that extends forward (rightward in FIG. 3) from the front end surface of this main body 51. The mating protruding part 52 has a substantially rectangular shape that extends in the direction of width of the main body 51, and the thickness of this mating protruding part 52 is less than that of the main body 51. Furthermore, a plurality of mating contact accommodating passages 53 are formed in the mating housing 50 in a single row along the direction of width so that these passages 53 pass through the mating housing 50 in the forward-rearward direction.

Moreover, each of the mating contacts 60 is fastened to the interior of the corresponding mating contact accommodating passage 53 in the mating housing 50, and comprises a secured part 61 that is fastened to the mating housing 50, an elastic contact section 62 that extends forward from the secured part 61 and that elastically contacts the undersurface of the corresponding contact section 22 of the contact 20, and a connecting part 63 that extends rearward from the secured part 61. Each mating contact 60 is formed by stamping and forming metal.

Furthermore, a metal shell 70 that covers the upper portion of the mating protruding part 52 is attached to the main body 51 of the mating housing 50. The mating protruding part 52 of the mating housing 50 and this metal shell 70 make up the mating part that is received inside the cavity 31 of the electrical connector A. The locking recesses 71 that are elastically locked by the locking projections 36 of the electrical connector a are formed in the portions of both side walls of the metal shell 70 corresponding to the mating part.

Next, a method for mating the electrical connector a and the mating connector B will be described.

When the mating part of the mating connector B mates with the cavity 31 of the electrical connector a in the arrow direction in FIG. 3, the locking projections 36 of the electrical connector a are elastically locked with the locking recesses 71 in the mating connector B. Then, the elastic contact sections 62 of the mating contacts 60 elastically contact the contact sections 22 of the contacts 20, so that the mating contacts 60 and the contacts 20 are electrically connected. In this mating, there are cases in which the mating connector B is twisted inside the cavity 31 of the housing 10. In such cases, the mating part of the mating connector B contacts the protective part 12*a* of the protective wall 12, so that striking the contact sections 22 of the contacts 20 is avoided, and there is no damage to the contact sections 22. When the mating part of the mating connector B contacts the protective part 12*a* of the protective wall 12, the protective wall 12 flexes upward or downward with the vicinity of the front surface of the main body 11 of the housing constituting the bottom portion of the cavity 31 as the fixed end. However, since the metal plate 40 that is formed so as to cover the upper surface 12*b* and two side surfaces 12*c* of the protective wall 12 is fastened to the main body 11 of the housing 10, the robustness of the protective wall 12 is increased by this metal plate 40. Accordingly, even if the protective wall 12 flexes, excessive deformation can be prevented by the metal plate 40, so that damage to the protective wall 12 can be prevented. As a result, damage to the contact sections 22 of the contacts 20 can be securely avoided. Furthermore, since a relatively thin metal plate 40 is used to increase the robustness of the protective wall 12, the size of the electrical connector a will not be large. Moreover, the height of the electrical connector a will not be great.

In addition, the protective wall 12 is formed in a substantially rectangular shape having the upper surface 12*b*, two side surfaces 12*c*, and undersurface 12*d*, the contact sections 22 of the contacts 20 are supported along the undersurface 12*d* of the protective wall 12, and the metal plate 40 is formed so as to cover the upper surface 12*b* and two side surfaces 12*c* of the protective wall 12 and fastened to the main body of the housing 10. Accordingly, it is possible to securely increase the robustness of the protective wall 12 by means of the metal plate 40 without interfering with the contact sections 22 of the contacts 20. Furthermore, since the metal plate 40 is formed so as to cover the upper surface 12*b* and two side surfaces 12*c* of the protective wall 12, it is possible to provide a shielding effect.

In order to release the mating state of the electrical connector a and the mating connector B, the mating connector B simply needs to be pulled out in the opposite direction from the arrow direction in FIG. 3.

An embodiment of the present invention was described above. However, the present invention is not limited to this embodiment, and various alterations and modifications can be made.

For example, it is not absolutely necessary that the metal plate 40 be formed so as to cover the upper surface 12*b* and two side surfaces 12*c* of the protective wall 12; it would be sufficient if at least portions of the surfaces of the protective wall 12 are covered.

Furthermore, the portion surrounded by the shell 30 on the front side of the main body 11 forms the cavity 31 that receives the mating part of the mating connector B. However, it would also be possible for the housing 10 itself to have a cavity that receives the mating part of the mating connector B.

Since a metal plate that covers at least portions of the surfaces of the protective wall is provided, the robustness of the protective wall is increased by this metal plate. Accordingly, when the mating connector is twisted inside the cavity of the housing during the mating of the mating connector, it is possible to prevent excessive deformation of the protective wall made of plastic and to prevent damage to the protective wall, even if the mating connector contacts the tip end of the protective wall. Consequently, damage to the contact sections of the contacts can be securely avoided. Furthermore, since a relatively thin metal plate is used to increase the robustness of the protective wall, the size of the electrical connector will not be large. Moreover, the height of the electrical connector will not be great.

Moreover, the metal plate is formed so as to cover the upper surface and two side surfaces of the protective wall, and is attached to the housing. Accordingly, the robustness of the protective wall can be securely increased by the metal plate without interference with the contact sections of the contacts. Furthermore, since the metal plate is formed so as to cover the upper surface and two side surfaces of the protective wall, it is possible to provide a shielding effect.

What is claimed is:

1. An electrical connector comprising:

a housing formed of an insulating material and having a cavity that receives the mating connector;

contacts having contact sections located in the housing;

a protective wall being integrally formed with the housing such that the protective wall protrudes from a bottom portion of the cavity into the interior of the cavity to protect the contact sections, the protective wall being attached to the housing and formed in a substantially rectangular shape having an upper surface, two side surfaces, and an undersurface, the contact sections being supported along the undersurface of the protective wall; and a metal plate that is located to cover and directly contact the upper surface and two side surfaces of the protective wall.

2. The electrical connector of claim 1 further comprising a metal shell being attached to the outside of the housing.

3. The electrical connector of claim 2 wherein a front end of the shell protrudes farther from the cavity than the protective wall.

4. The electrical connector of claim 2 wherein the metal shell further comprises fastening parts for fastening the shell to the circuit board.

5. An electrical connector comprising:

a housing formed of an insulating material and having a cavity that receives the mating connector;

contacts having contact sections located in the housing;

a protective wall being integrally formed with the housing such that the protective wall protrudes from a bottom portion of the cavity into the interior of the cavity to protect the contact sections; and a metal plate that covers at least portions of the surfaces of the protective wall;

wherein the protective wall is attached to the housing and formed in a substantially rectangular shape having an upper surface, two side surfaces, and an undersurface;

wherein the contact sections are supported along the undersurface of the protective wall; and wherein the metal plate is located to cover the upper surface and two side surfaces of the protective wall.

6. The electrical connector according to claim 5, further comprising: a metal shell being attached to the outside of the housing.

7. The electrical connector according to claim 6, wherein a front end of the shell protrudes farther from the cavity than the protective wall.

8. The electrical connector according to claim 6, wherein the metal shell further comprises fastening parts for fastening the shell to the circuit board.

9. The electrical connector according to claim 5, further comprising:

a metal shell being attached to the outside of the housing;

wherein a front end of the shell protrudes farther from the cavity than the protective wall.

10. The electrical connector according to claim 9, wherein the metal shell further comprises fastening parts for fastening the shell to the circuit board.

11. An electrical connector comprising:

a housing formed of an insulating material and having a cavity that receives the mating connector;

contacts having contact sections located in the housing;

a protective wall being integrally formed with the housing such that the protective wall protrudes from a bottom portion of the cavity into the interior of the cavity to protect the contact sections, the protective wall being attached to the housing and formed in a substantially rectangular shape having an upper surface, two side surfaces, and an undersurface, the contact sections being supported along the undersurface of the protective wall; and a metal plate that is located to cover and directly contact the upper surface and two side surfaces of the protective wall, the metal plate being configured to limit deformation of the protective wall.

12. The electrical connector of claim 11 further comprising a metal shell being attached to the outside of the housing.

13. The electrical connector of claim 12 wherein a front end of the shell protrudes farther from the cavity than the protective wall.

14. The electrical connector of claim 12 wherein the metal shell further comprises fastening parts for fastening the shell to the circuit board.

* * * * *